US005424817A

United States Patent [19]

Imamiya et al.

[11] Patent Number: 5,424,817

[45] Date of Patent: Jun. 13, 1995

[54] DEVELOPING DEVICE HAVING DISORDERING MEMBER IN CONTACT WITH SUPPLY ROLLER

[75] Inventors: Koji Imamiya, Kanagawa; Toshiro Honda, Tokyo; Takashi Shimazaki; Minoru Tezuka, both of Kanagawa, all of Japan

[73] Assignee: Kabushiki Kaisha Toshiba, Kawasaki, Japan

[21] Appl. No.: 204,094

[22] Filed: Mar. 2, 1994

[30] Foreign Application Priority Data

Jul. 30, 1993 [JP] Japan ..... 5-189735

[51] Int. Cl.[6] ..... G03G 15/06

[52] U.S. Cl. ..... 355/261; 118/651

[58] Field of Search ..... 355/259, 261, 245, 246; 118/651, 661

[56] References Cited

U.S. PATENT DOCUMENTS

| | | | |
|---|---|---|---|
| 4,378,158 | 3/1983 | Kanbe | 355/259 |
| 4,930,438 | 6/1990 | Demizu et al. | 118/651 |
| 5,016,560 | 5/1991 | Asada et al. | 118/653 |
| 5,047,805 | 9/1991 | Oka et al. | 355/253 |
| 5,170,213 | 12/1992 | Yamaguchi et al. | 355/259 X |
| 5,333,040 | 7/1994 | Imamiya | 355/246 |

FOREIGN PATENT DOCUMENTS

| | | | |
|---|---|---|---|
| 0112753 | 10/1978 | Japan | 355/259 |
| 0008175 | 1/1987 | Japan | 355/259 |
| 0027773 | 2/1987 | Japan | 355/259 |
| 4-14796 | 3/1992 | Japan . | |
| 4-30601 | 7/1992 | Japan . | |

*Primary Examiner*—Robert B. Beatty

*Attorney, Agent, or Firm*—Foley & Lardner

[57] ABSTRACT

A device for developing a latent image on an image bearing member includes a developing roller, rotatably mounted facing the image bearing member, for transferring a developing agent to the image bearing member, and a supply roller, rotatably mounted adjacent to the developing roller, for supplying the developing agent to the developing roller at a supplying portion. The developing agent is stored in the storing member and is provided to the supply roller upstream of the supplying portion with respect to a rotating direction of the supply roller. A disordering member, mounted downstream of the supplying portion with respect to the rotating direction of the supply roller, disorders the developing agent on the surface of the supply roller to prevent the developing agent from causing hardening of the supply roller.

22 Claims, 6 Drawing Sheets

DEVELOPING DEVICE HAVING DISORDERING MEMBER IN CONTACT WITH SUPPLY ROLLER

BACKGROUND OF THE INVENTION

1. Field of the Invention

The present invention relates to a developing unit for visualizing an electrostatic latent image and, more particularly, to a developing unit capable of forming a high-quality image using a monocomponent developer and an image forming apparatus having the developing unit.

2. Description of the Related Art

A developing unit used in an image forming apparatus such as an electrophotographic apparatus and an electrostatic recording apparatus, as disclosed in Japanese Laid-open Patent Publication (Kokai) No. 61-169859 has a hopper containing toner. The toner is supplied from the hopper to an electrostatic latent image formed on a photosensitive drum by rotation of a developing roller. A toner supply roller, which rotates in the same direction as that of the rotation of the developing roller, is brought into contact with the developing roller to supply the toner to the developing roller. Futhermore, the end of a doctor blade serving as a thin-layer-forming member is brought into contact with the developing roller by uniform pressure, and a thin layer of the toner is formed on the developing roller. The thin layer is made close to or placed into contact with the photosensitive drum by the rotation of the developing roller; thus the electrostatic latent image is made visible.

In a conventional developing unit having the above structure, toner cannot be supplied sufficiently to the developing roller and, if non-magnetic toners are used, they cannot be supplied by a magnetic force. For this reason, when a solid image is formed, the density of the trailing edge of the image is lower than the leading edge thereof. When a plurality of solid images are formed in sequence, the density of the images is depressed or a toner layer is not formed completely. Futhermore, over time, toner gets into a surface layer of the toner supply roller and the surface layer hardens. For this reason, the capability of transfering toner of the toner supply roller is decreased and the condition of the toner layer gets worse.

SUMMARY OF THE INVENTION

The object of the invention is to provide a developing unit capable of supplying non-magnetic developer sufficiently through a service life, and an image forming apparatus having the developing unit.

In accordance with the present invention, the foregoing object, among others, is achieved by providing a device for developing a latent image on an image bearing member,comprising: a developing roller, rotatably mounted facing an image bearing member, for transferring a developing agent to the image bearing member; a supply roller, rotatably mounted adjacent to the developing roller, for supplying the developing agent to the developing roller at a supplying portion; means for storing the developing agent to provide the supply roller, the developing agent in the storing means being provided upstream of the supplying portion with respect to a rotating direction of the supply roller; and a disordering member, mounted downstream of the supplying portion with respect to the rotating direction of the supply roller, for disordering the developing agent on the surface of the supply roller. Other objects, features, and advantages of the present invention will become apparent from the following detailed description. It should be understood, however, that the detailed description and specific examples, while indicating preferred embodiments of the invention, are given by way of illustration only, since various changes and modification within the spirit and scope of the invention will become apparent to those skilled in the art from this invention description.

BRIEF DESCRIPTION OF THE DRAWINGS

A more complete appreciation of the present invention and many of the attendant advantages thereof will be readily obtained as the invention becomes better understood by reference to the following detailed description, when considered in connection with the accompanying drawings, wherein.

DETAILED DESCRIPTION OF THE PREFERRED EMBODIMENTS

Figure 1:
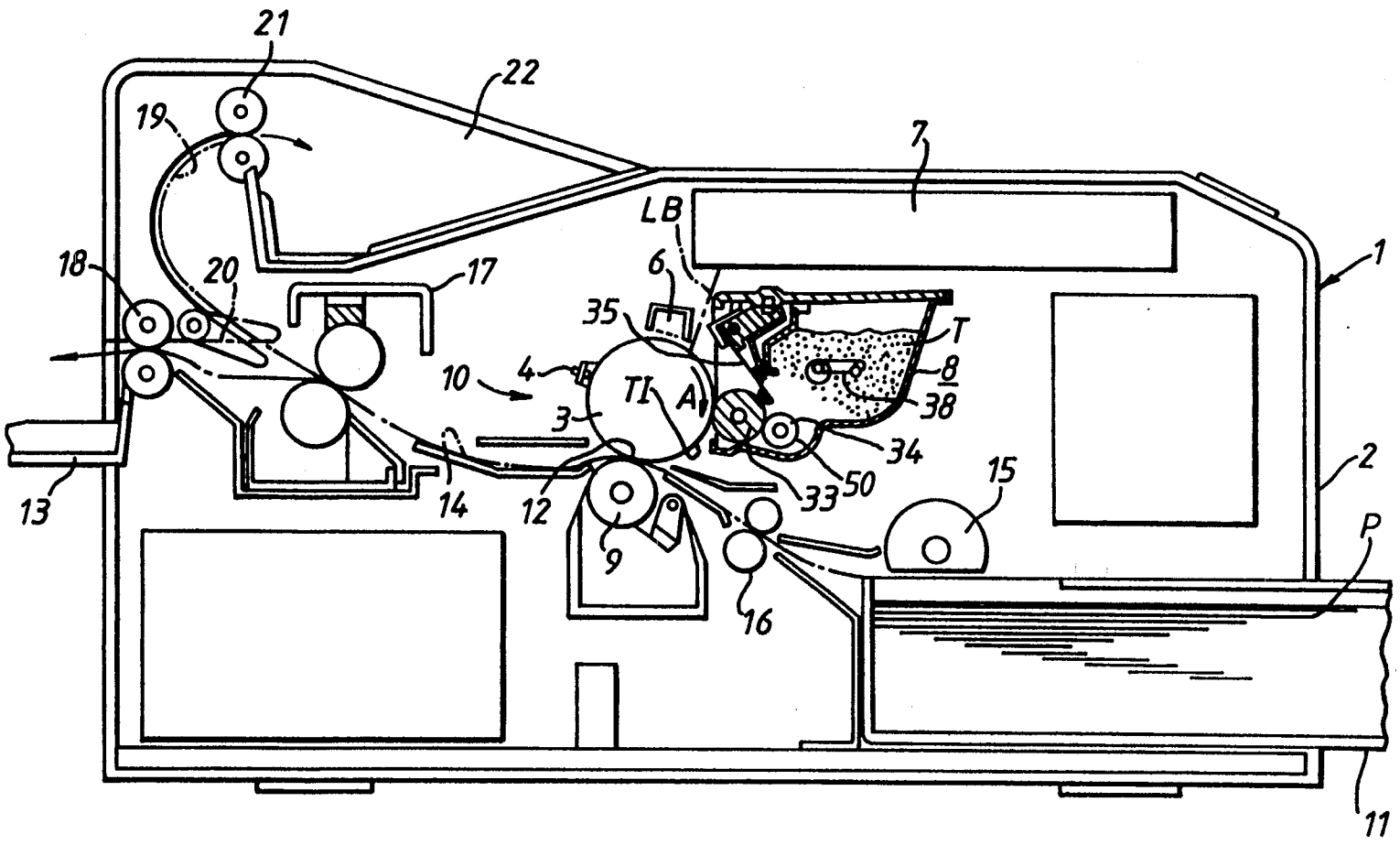
FIG. 1 is a sectional view of the image forming apparatus.

FIG. 1 shows an image forming apparatus 1 which incorporates a developing device according to an embodiment of the present invention.

As shown in FIG. 1, image forming apparatus 1 includes a housing 2 and a photosensitive drum 3 for use as an image bearing member. Photosensitive drum 3 is located substantially in the center of housing 2 so as to be rotatable in the direction of an arrow A. Photosensitive drum 3 is formed of a photoconductive material based on an organic photoconductor (OPC). Photosensitive drum 3 is surrounded by the following elements; a red LED 4 for use as a de-electrifier having the function mentioned later, a scorotron charger 6, a laser unit 7 for use as a electrostatic latent image forming means, a developing device 8 doubling as a cleaning unit, and a transfer roller 9, which are successively arranged in the rotating direction of drum 3. These components constitute image forming means 10 for forming a toner image TI as a developer image on the circumferential surface of drum 3.

A paper transportation path 14 is defined in housing 2. Paper transportation path 14 is used to guide a paper sheet P as a transfer medium, taken out of a paper cassette 11 attached to one side of housing 2, to a receiving tray 13 on the other side of housing 2 through an image transfer section 12 between photosensitive drum 3 and transfer roller 9.

An aligning roller pair 16 is arranged on the upstream side of paper transportation path 14 with respect to image transfer section 12. Roller pair 16 aligns the leading edge of paper sheet P, taken out of paper cassette 11 by means of a paper supply roller 15, and then timely feeds the sheet into transfer section 12.

A fixing unit 17 and a discharge roller pair 18 are arranged on the downstream side of transfer section 12. Fixing unit 17 fixes toner image TI transferred to paper sheet P. Discharge roller pair 18 serves to discharge fixed sheet P onto receiving tray 13.

A gate 20 is located between fixing unit 17 and discharge roller pair 18. Gate 20 guides paper sheet P from unit 17 to a reverse transportation path 19, if necessary. Paper sheet P introduced into reverse transportation path 19 is delivered to a paper discharge section 22 by means of a discharge roller pair 21 with its image forming surface downward. Paper discharge section 22 is formed by a recess in the top of housing 2.

The following is a description of an outline of the image forming operation of image forming apparatus 1 constructed in this manner.

First, photosensitive drum 3 is rotated in the direction of arrow A, and the circumferential surface of photosensitive drum 3 is negatively charged in a substantially uniform manner by means of scorotron charger 6 so that a potential of the circumferential surface is between −100 V and −700 V, preferably, 550 V. Then, a laser beam LB from laser unit 7 is applied onto the charged region to expose it in accordance with image information to be recorded. As a result, an electrostatic latent image is formed on the circumferential surface of photosensitive drum 3. As photosensitive drum 3 rotates, the latent image faces developing device 8.

Figure 2:
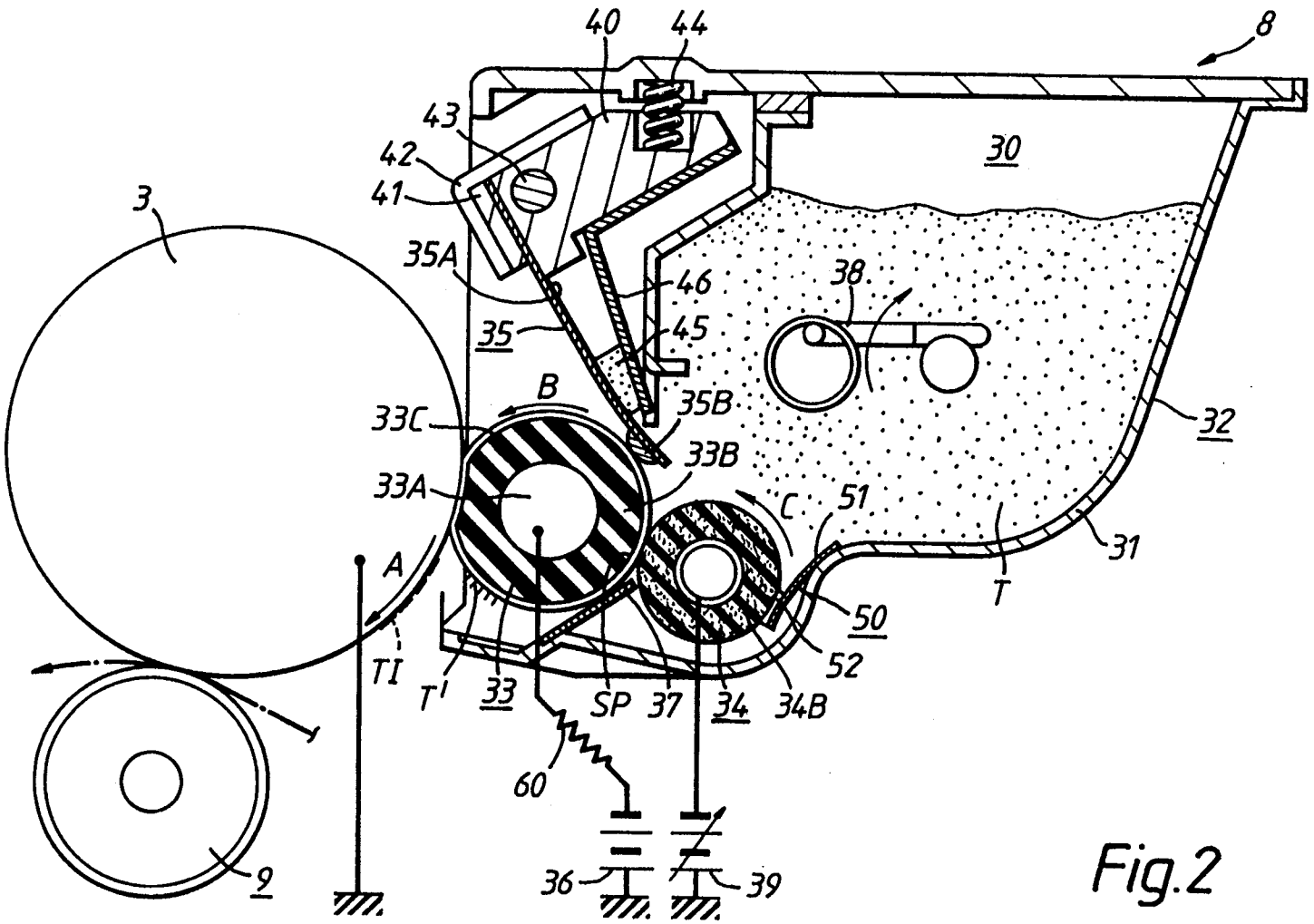
FIG. 2 is a sectional view of the developing device.

Thereupon, a developing roller 33, which has a layer of a frictionally chargeable toner T for use as a so-called one-component developing agent formed thereon, starts to rotate, whereby toner T is caused to adhere to the electrostatic latent image on photosensitive drum 3, thus forming toner image TI (see FIG. 2). In this case, toner particles T adhere to the exposed portion of the circumferential surface of photosensitive drum 3 so that the toner image is subjected the so-called reversal development. Developed toner image TI is transported to transfer section 12 which faces transfer roller 9.

Meanwhile, paper sheet P, taken out from paper cassette 11 by means of paper supply roller 15, is delivered to transfer section 12 by means of aligning roller pair 16 in synchronism with the rotation of photosensitive drum 3. The back of delivered sheet P is charged to the positive polarity by means of transfer roller 9. Thus, toner image TI on the surface of photosensitive drum 3 is electrostatically attracted and transferred to paper sheet P.

After the transfer process, paper sheet P is delivered to fixing unit 17, whereupon toner T is melted and fixed to paper sheet P by means of heat under pressure, and paper sheet P is then discharged to receiving tray 13 or paper discharge section 22.

The construction of developing device 8 will now be described in detail.

As shown in FIG. 2, developing device 8 includes a casing 32 which has a toner hopper 31 as its integral part, and a toner storage section 30 for storing toner T is defined in hopper 31. Casing 32 has an opening which faces photosensitive drum 3, and developing roller 33, which doubles as a cleaning roller, is located in the vicinity of the opening. Developing roller 33 is elastically in contact with photosensitive drum 3 so that the predetermined nip width is produced by deformation. Developing roller 33 is rotatable in the direction of an arrow opposite to the rotating direction of photosensitive drum 3. The peripheral speed of photosensitive drum 3 is set at, for instance, 70 mm/sec, and the peripheral speed of developing roller 33 is set at, for instance, 180 mm/sec. The contact width between photosensitive drum 3 and developing roller 33 is about 0.5 to 4.0 mm.

At the bottom of toner storage section 30, a toner supply roller 34, for supplying the toner T to developing roller 33, is located behind developing roller 33. Toner supply roller 34, which is in rolling contact with developing roller 33, is rotated in the direction of an arrow C.

In casing 32, a blade 35 for forming a thin toner layer is located over developing roller 33. Blade 35 regulates the toner delivery by means of developing roller 33 so that a thin layer of toner T is formed on the surface of developing roller 33. The average particle diameter of toner T is about 6 μm to 15 μm. Toner T is charged at about −5 μc/g to −30 μc/g by the friction between developing roller 33 and blade 35. Photosensitive drum 3 is a negative chargeable OPC drum which is used in image forming apparatus 1 of the reversal development type, so toner T is negatively charged. A recovery blade 37 is arranged in contact with the underside of developing roller 33. A mixer 38 for stirring toner T is provided in toner storage section 30.

Toner T in toner hopper 31 is supplied to toner supply roller 34 while it is being stirred by mixer 38. Then, toner T adhered to the surface of toner supply roller 34 is transported to developing roller 33 at a supplying portion SP. Accordingly, toner T in toner hopper 31 should be supplied to toner supply roller 34 upstream of supplying portion SP with respect to the rotating direction.

Toner supply roller 34 is arranged in contact with the surface of developing roller 33. Toner supply roller 34 and developing roller 33 move in the same direction, that is, in the against-direction indicated by arrow C at supply portion SP between them. Therefore, toner supply roller 34 also serves as a collecting roller for collecting some of toner T remaining on developing roller 33.

A disordering member 50 as a disordering means is arranged in contact with the surface of toner supply roller 34 downstream of the supplying portion SP with respect to the rotating direction.

In developing device 8, developing roller 33 is expected to have an elasticity, a smoothness and an electrical conductivity.

Figure 3:
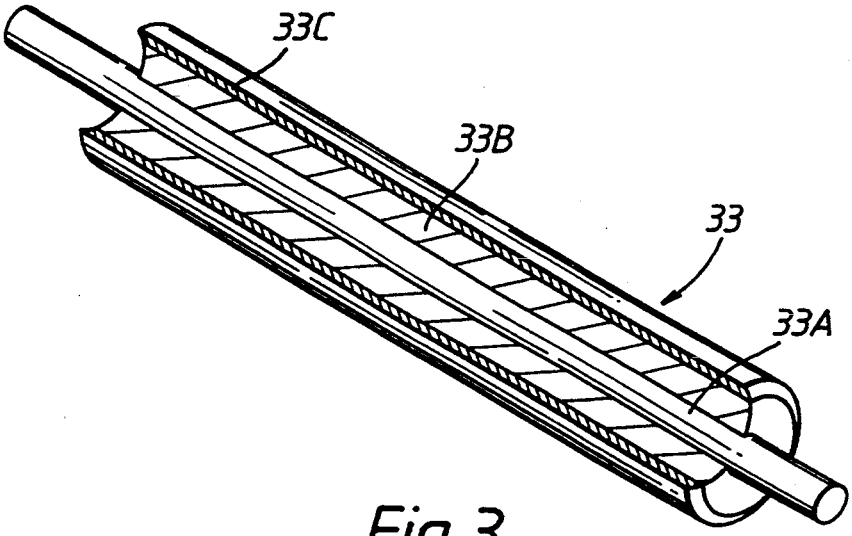
FIG. 3 is a cutaway perspective view of a developing roller of the developing device.

As shown in FIGS. 2 and 3, developing roller 33 is an elastic roller including a metal shaft 33A, an elastic layer 33B formed on metal shaft 33A, and a surface conductive layer 33C formed on elastic layer 33B.

Elastic layer 33B is formed of silicone rubber whose hardness is about 25, elongation is about 425%, and resistance is about $5\times10^3$ Ωcm. Surface conductive layer 33C has a thickness of about 70 μm and is formed of conductive polyurethane paint whose resistance is about $5\times10^3$ Ωcm and elongation is about 353%. Thus, developing roller 33 is has a rubber hardness of about 30, a surface resistance of about 100 kΩ, and a surface roughness of about 3 μm, and the resistance of metal shaft 34A becomes about 100K Ω. As shown in FIG. 2, metal shaft 33A of developing roller 33 is connected, through a protective resistor 60 which is 100K to 50M Ω, with a toner supply bias power source 36 for applying a predetermined bias voltage to developing roller 33. In the case that the surface potential of photosensitive drum 3 is −550 V, the voltage of developing bias power source is adjusted to −200 V.

Recovery blade 37, which is a leaf spring made of a phosphorous bronze, is arranged in contact with the lower surface of developing roller 33. The one end of recovery blade 37 is fixed on casing 32, and the other end is biased against developing roller 33 along the longitudinal direction of recovery blade 37. The pressure to developing roller 33 is about 3 g/cm$^2$.

Toner supply roller 34 which rotates in the same direction as developing roller 33, includes a flexible polyurethane foam layer 34B having a conductivity of $10^6$ Ωcm or less around a metal shaft 34A thereof so as to transport toner T and prevent a condensation of toner T in the bottom portion. The peripheral speed of toner supply roller 34 is about 90 mm/sec.

A toner supply bias power source (variable) 39 applies a toner supply bias to metal shaft 34A so as to move toner T from toner supply roller 34 to developing roller 33 satisfactorily.

Blade 35 is held in casing 32 by means of a first blade holder 40, a spacer 41, and a second blade holder 42. First blade holder 40 is rockably supported by means of a shaft 43, and is continually urged to rotate in a predetermined direction by a plurality of compression springs 44 for pressurization. Thus, blade 35 is pressed against the outer circumferential surface of developing roller 33 by the urging force of springs 44.

Since the spring contact of compression spring 44 is lower than that of thin plate 35A, the pressing force of blade 35 hardly changes even through the contact portion thereof is worn, and a good layer of toner T can be maintained. The pressure from blade 35 to developing roller 33 is about 80 g/cm$^2$.

A foamed material 45 formed of Molt prene (trademark) is pasted on the back of blade 35. It is in engagement with a baffle plate 46 which is attached to first blade holder 40. Thus, foamed material 45 restrains blade 35 from vibrating, so that a satisfactory layer of toner T can be formed.

Blade 35 includes a thin spring member 35A made of a phosphorous bronze, for use as a support member, and a tip 35B of resin or elastic rubber material, such as silicon rubber or urethane rubber, attached to the distal end portion of thin leaf spring member 35A. Tip 35B includes projection with a semicircular cross section and extends at least longer than the image forming width along the longitudinal direction of leaf spring member 35A. Toner particles T passing between blade 35 and developing roller 33 are triboelectrically charged with the same polarity (negative) as that of photosensitive drum 3, with the result that at most three layers of toner particles T are formed on the surface of developing roller 33.

Figure 4:
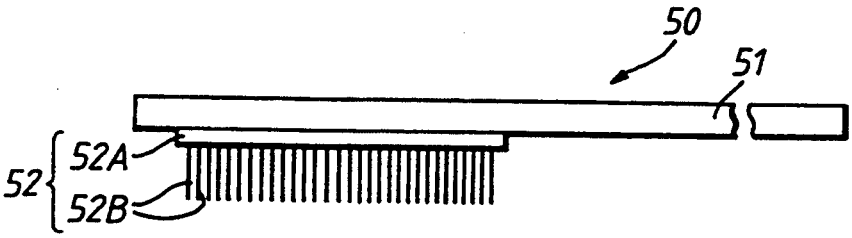
FIG. 4 is a side view of the disordering member.

As shown in FIG. 4, disordering member 50 includes an elastic supporting plate 51 with a thickness of about 0.1 mm and a brush member 52 as a contacting member adhered to the surface of elastic supporting plate 51. Elastic supporting plate 51 is formed of a synthetic resin, such as a polyethylene terephthalate film (manafactured by E. I. du Pont de Nemours & Co., of America with the trademark "Mylar"). Brush member 52 is a velveteen cloth which is composed of a cotton base 52A and a plurality of fibers 52B with a predetermined electric resistance implanted in cotton base 52A. Fibers 52B have 1 to 10 denier thickness, 0.2 mm to 5.0 mm length and 10,000/cm$^2$ to 50,000/cm$^2$ density. Available for fibers 52B are nylon fibers, rayon fibers, acrylic fibers, polyester fibers, carbon-dispersed nylon fibers, carbon-dispersed rayon fibers, carbon-dispersed acrylic fibers, and carbon-dispersed polyester fibers.

As shown in FIG. 2, the one end portion of disordering member 50 is fixed on casing 32, and the opposite end portion of disordering member 51 is arranged in contact with polyurethane foam layer 34B by the elastic force of elastic supporting plate 51. Brush member 52 is contacted with polyurethane foam layer 34B at a predetermined depth H. As used in this application, the term "contact depth" refers to the distance H in the direction of the compression between polyurethane foam layer 34B and brush member 52.

Toner particles T supplied onto developing roller 33 by toner supply roller 34 are triboelectrically charged by the contact with the surface of developing roller 33 and transported to the contact portion with blade 35 by the electrostatic force and the physical force.

In the contact portion between blade 35 and developing roller 33, toner particles T on developing roller 33 are triboelectrically charged while the amount of toner particles T passing is regulated so that at most three layers of toner T are formed on the surface of developing roller 33. Passing the contact portion, toner T is satisfactorily charged, and the layer of toner T is uniformly formed on developing roller 33. Then toner T is transported to the contact portion with photosensitive drum 3 and serves to develop the electrostatic latent image formed on photosensitive drum 3 to form toner image TI. A residual toner T' which is not attached to the electrostatic latent image, return to casing 32 through recovery blade 37.

Now, some results of tests which clearly exhibit the effect of the present invention.

[TEST 1]

Figure 5:
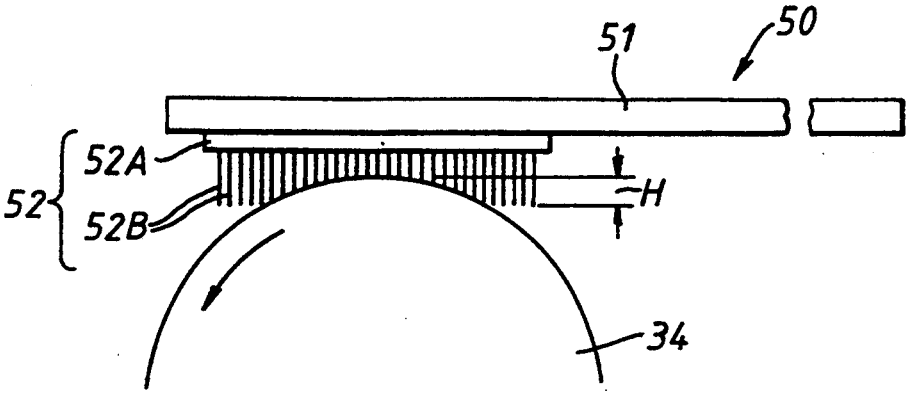
FIG. 5 is a side view of the disordering member and the toner supplying roller.

As shown in FIG. 5, disordering member 50 is a nylon fibers-implanted brush (manufactured by NIPPON SEAL Co.,LTD) of which the brush was implanted in an upright position.

Figure 6:
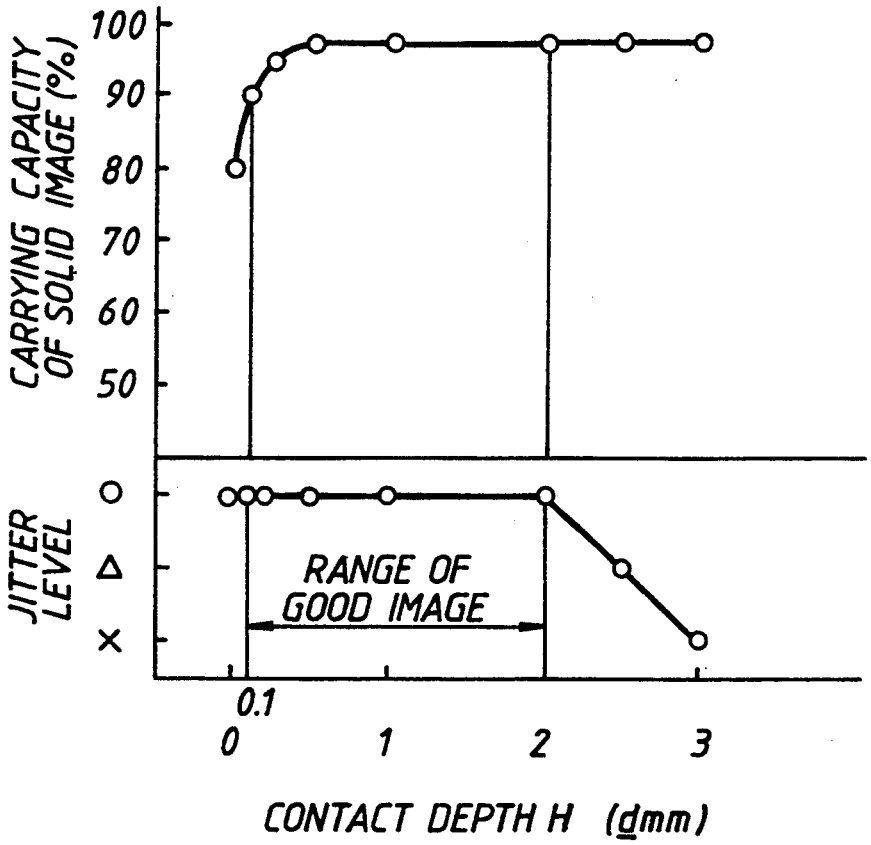
FIG. 6 shows characteristic curves representing a correlation between the contact depth of the brush member to the polyurethane foam layer and a correlation between the contact depth and the jitter level of the toner image.

FIG. 6 shows a correlation between the contact depth H (dmm) of brush member 52 to polyurethane foam layer 34B and a carrying capacity of a solid image and shows a correlation between the contact depth H and a jitter level of toner image TI.

In developing device 8 to which a non-magnetic one-component developing technique is applied, non-magnetic toner T cannot be transported using magnetic force. Therefore, when developing a solid image, the supply of toner T to developing roller 33 cannot be met. Consequently, the difference between the image density at the leading edge of paper sheet P and the image density at the trailing edge of the paper sheet P increases.

The carrying capacity of the solid image is defined as follows, and a variation in density between the leading edge and the trailing edge of the solid image is evaluated.

$$Rb(\%)=(De/Ds)\times 100(\%)$$

where Rb is the carrying capacity of the solid image, Ds is a density of the leading edge of the solid image, and De is a density of the trailing edge of the solid image.

If Ds and De are each 1.2 or more and Rb is 90% or more, a good solid image can be obtained.

As is apparent from FIG. 6, when the contact depth H is smaller than 0.1 mm, the carrying capacity of the solid image is less than 90% and is defective. When the contact depth H is larger than 2.0 mm, torque increases and jitter occurs accordingly. Thus, in relationship with the contact depth H, the range of good image is from d=0.1 mm to d=2.0 mm.

Figure 7:
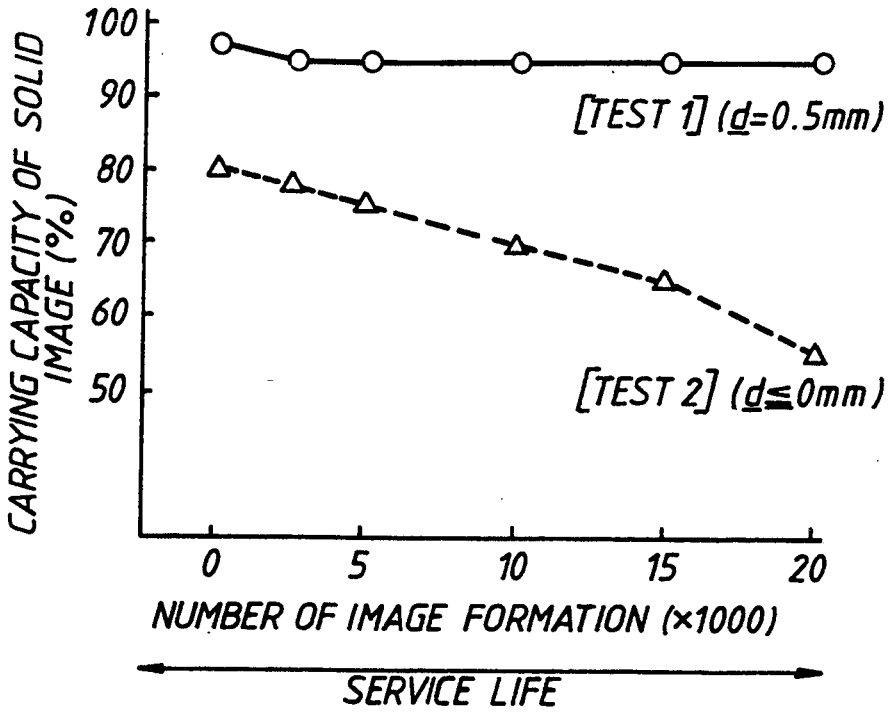
FIG. 7 shows characteristic curves representing a correlation between the carrying capacity of the solid image and the number of image formations.

When developing device 8 of which the contact depth H is set at 0.5 mm is used in image forming apparatus 1, the carrying capacity of the solid image during the service life is shown by a solid line in FIG. 7. In this case, the carrying capacity of the solid image was larger than 90% over the entire service life, and a good solid image could be obtained.

[TEST 2(COMPARISON TEST TO TEST 1)]

The same test as that performed in TEST 1 discussed above was performed except that disordering member 50 was not arranged in developing device 8, in other words, the contact depth H is less than 0 mm. As shown by a dotted line in FIG. 7, the carrying capacity of the solid image was less than 90% from the beginning of the service life and steadily reduced as the number of image formations increased. Therefore, a good solid image could not be obtained.

[TEST 3]

Figure 8:
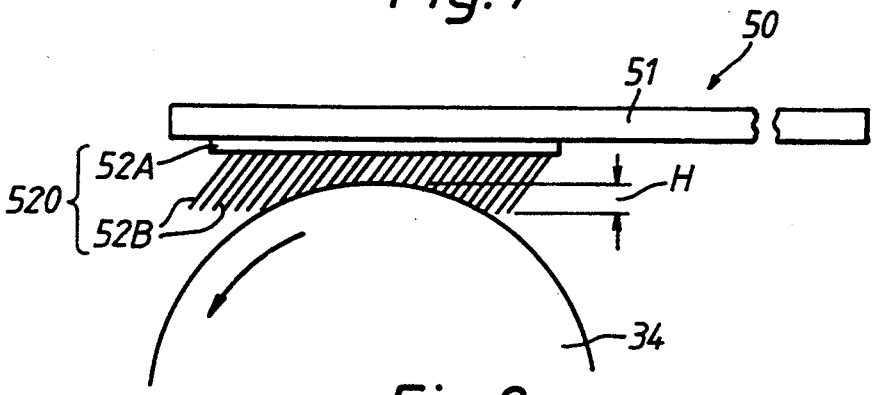
FIG. 8 is a side view of the disordering member of the another embodiment and the toner supplying roller.

The same test as that performed in TEST 1 discussed above was performed by using a brush member 520 on which fibers 52B of disordering member 50 were implanted in a inclined condition, as shown in FIG. 8. Two kinds of brush member 520 were used in this TEST. Fibers 52B of one brush member 520 were inclined with the rotational direction of toner supply roller 34. Fibers 52B of the other brush member 520 was inclined in the direction opposite to rotation. In both cases, the carrying capacity of the solid image was larger than 90% over the entire service life, and a good solid image could be obtained, as in the TEST 1. In particular, when the inclined direction of fibers 52B was in the direction of rotation, the torque of developing device 8 was less than that of developing device 8 used in the TEST 1.

[TEST 4]

Figure 9:
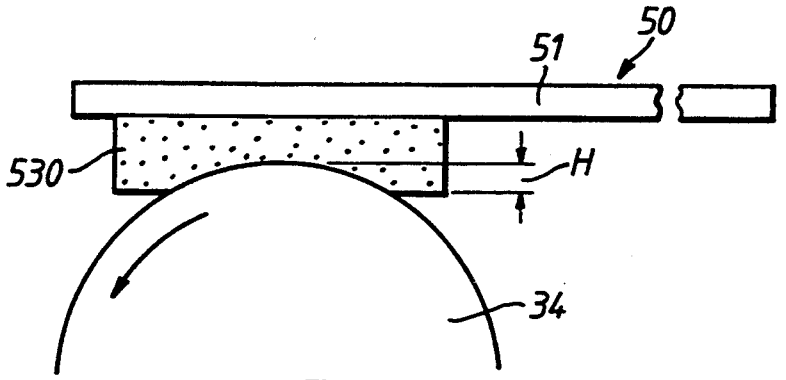
FIG. 9 is a side view of the disordering member of the further embodiment and the toner supplying roller.

The same test as that performed in TEST 1 discussed above was performed except that brush member 52 of disordering member 50 was replaced with a polyurethane foam block 530, as shown in FIG. 9. In this case, the carrying capacity of the solid image was larger than 90% over the entire service life, and a good solid image could be obtained, as in the TEST 1 and the TEST 3.

When polyurethane foam block 530 is used in developing device 8, since polyurethane foam block 530 is cheaper than the brush member 52 or brush member 520, the manufacturing cost of developing device 8 is reduced.

[TEST 5(COMPARISON TEST FOR TEST1, TEST3 AND TEST4)]

Figure 10:
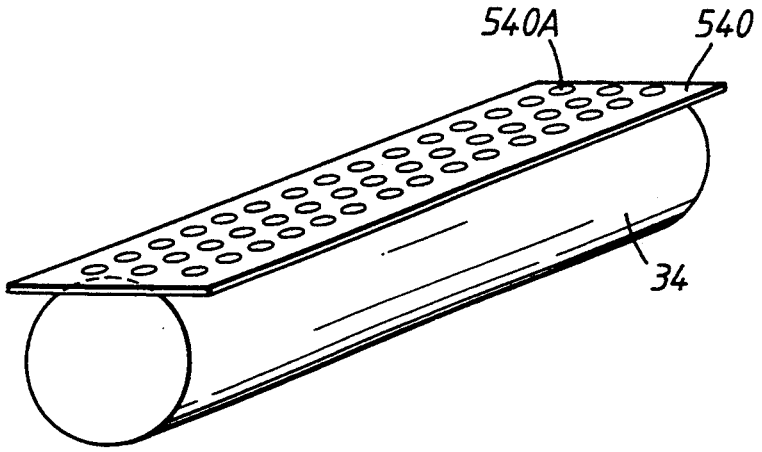
FIG. 10 is a perspective view of the scraping metal plate and the toner supplying roller.

The same test as that performed in TEST 1 discussed above was performed except that disordering member 50 was replaced with a scraping metal plate 540 made of SUS 304 (JIS), as shown in FIG. 10. Scraping metal plate 540 has a 1 mm thickness, and a plurality of openings of about 2 mm diameter were arranged with separation of a distance of 4 mm.

Figure 11:
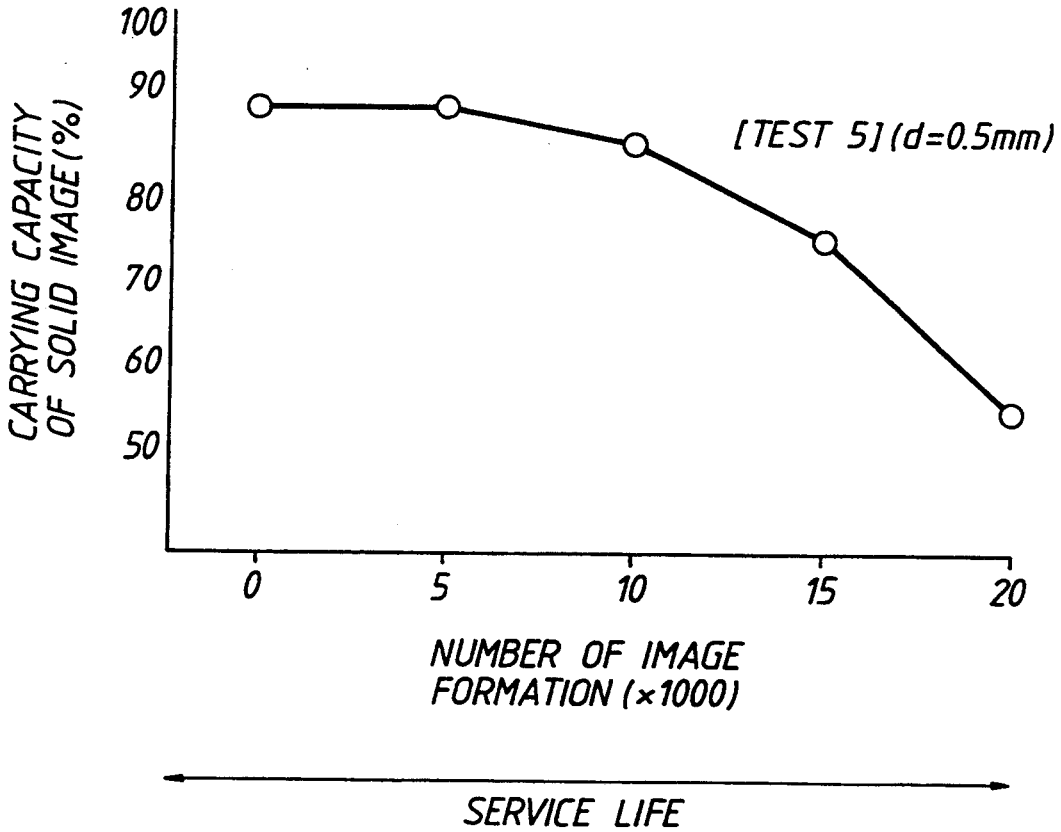
FIG. 11 shows characteristic curves representing a correlation between the carrying capacity of the solid image and the number of image formations.

In this case, the outer diameter of toner supply roller 34 was reduced by 0.8 mm during the service life. As shown in FIG. 11, therefore, the carrying capacity of the solid image grew worse corresponding to the reduction of the outer diameter, and a good solid image could not be obtained.

According to developing device 8 and image forming apparatus 1, as described in detail above, since disordering member 50 contacts with toner supply roller 34 so that the contact depth H is from 0.1 mm to 2.0 mm, toner T is triboelectrically charged. Moreover, since disordering member 50 disorders toner T gotten into the surface layer of toner supply roller 34 for preventing hardening thereof, the carrying capacity of toner supply roller 34 does not decrease. Therefore, a high-quality image of uniform density can be steadily developed without involving an insufficient toner supply to developing roller 33 through the service life.

In this invention, the disordering member has two important functions. The first is a function for triboelectrically charging the toner with the toner supply roller to increase the carrying capacity of the solid image, The second is a function for disordering the toner gotten into the surface of the polyurethane foam layer to prevent hardening of the the polyurethane foam layer.

The present invention may be also adapted for a non-contact type developing device which is arranged so that the developing roller is not in contact with the photosensitive drum.

The present invention may be embodied in other specific forms without departing from the spirit or essential characteristics thereof. The present embodiment is therefore to be considered in all respects as illustrative and not restrictive, the scope of the present invention being indicated by the appended claims rather than by the foregoing description, and all changes which come within the meaning and range of equivalency of the claims are therefore intended to be embraced therein.

What is claimed is:

1. A device for developing a latent image on an image bearing member, comprising:

a developing roller, rotatably mounted facing the image bearing member, for transferring a developing agent to the image bearing member;

a supply roller having a resilient foam polymer surface layer, rotatably mounted adjacent to the developing roller, for supplying the developing agent to the developing roller at a supplying portion;

means for storing the developing agent to be provided to the supply roller, the developing agent in the storing means being provided upstream of the supplying portion with respect to a rotating direction of the supply roller; and means for disordering the developing agent on the surface of the supply roller to an extent sufficient to prevent the developing agent from causing hardening of the resilient foam polymer surface layer, whereby the carrying capacity of the developed image is maintained above about 90% over the life of the developing device when used to produce multiple image copies.

2. The device according to claim 1, wherein the disordering means includes a contacting portion which is arranged in contact with the surface of the supply roller at a predetermined contact depth, and the contacting portion triboelectrically charges the developing agent on the supplying roller.

3. The device according to claim 2, wherein the predetermined contact depth is from 0.1 mm to 2.0 mm.

4. The device according to claim 3, wherein the contacting portion includes a polyurethane foam block.

5. The device according to claim 2, wherein the contacting portion includes a base member and a plurality of fibers implanted in the base member, the fibers contacting the supply roller.

6. The device according to claim 2, wherein the predetermined contact depth produces an amount of compression sufficient to maintain said carrying capacity above the 90% level over the life of the developing device when used to produce multiple image copies.

7. A device for developing a latent image on an image bearing member, comprising:

a developing roller, rotatably mounted facing the image bearing member, for transferring a developing agent to the image bearing member;

a supply roller having a resilient foam polymer surface layer, rotatably mounted adjacent to the developing roller, for supplying the developing agent to the developing roller at a supplying portion;

means for storing the developing agent to be provided to the supply roller, the developing agent in the storing means being provided upstream of the supplying portion with respect to a rotating direction of the supply roller; and a disordering member, mounted downstream of the supply portion for disordering the developing agent on the surface of the supply roller, the disordering member having a contacting portion which is arranged in contact with the surface of the supply roller at a contact depth of from 0.1 mm to 2.0 mm, the contacting portion triboelectrically charging the developing agent on the supply roller, the contacting portion including a base member and a plurality of fibers implanted in the base member, the fibers contacting the supply roller.

8. The device according to claim 7, wherein the fibers have 1 to 10 denier thickness, 0.2 mm to 5.0 mm length and 10,000/cm$^2$ to 50,000/cm$^2$ density.

9. The device according to claim 8, wherein the fibers include at least one of nylon fibers, rayon fibers, acrylic fibers, polyester fibers, carbon-dispersed nylon fibers, carbon-dispersed rayon fibers, carbon-dispersed acrylic fibers and carbon-dispersed polyester fibers.

10. The device according to claim 7, wherein substantially all of the fibers are implanted in the base member at a predetermined non perpendicular angle.

11. The device according to claim 10, wherein the fibers are inclined with the rotational direction of the supply roller.

12. An image forming apparatus, comprising:

means for forming a latent image on a image bearing member; and means for developing the latent image formed by the image forming means, the developing means including, a developing roller, rotatably mounted facing the image bearing member, for transferring a developing agent to the image bearing member;

a supply roller having a resilient foam polymer surface layer, rotatably mounted adjacent to the developing roller, for supplying the developing agent to the developing roller at a supplying portion;

means for storing the developing agent to be provided to the supply roller, the developing agent in the storing means being provided upstream of the supplying portion with respect to a rotating direction of the supply roller; and means for disordering the developing agent on the surface of the supply roller to an extent sufficient to prevent the developing agent from causing hardening of the resilient foam polymer surface layer, whereby the carrying capacity of the developed image is maintained above about 90% over the life of the developing device when used to produce multiple image copies.

13. The image forming apparatus according to claim 12, wherein the disordering means includes a contacting portion which is arranged in contact with the surface of the supply roller at a contact depth, and the contacting portion triboelectrically charges the developing agent on the supplying roller.

14. The image forming apparatus according to claim 13, wherein the predetermined contact depth is from 0.1 mm to 2.0 mm.

15. The image forming apparatus according to claim 14, wherein the contacting portion includes a polyurethane foam block.

16. The image forming apparatus according to claim 11, wherein the contacting portion includes a base member and a plurality of fibers implanted in the base member, the fibers contacting the supply roller.

17. An image forming apparatus, comprising:

means for forming a latent image on a image bearing member; and means for developing the latent image formed by the image forming means, the developing means including, a developing roller, rotatably mounted facing the image bearing member, for transferring a developing agent to the image bearing member;

a supply roller having a resilient foam polymer surface layer, rotatably mounted adjacent to the developing roller, for supplying the developing agent to the developing roller at a supplying portion;

means for storing the developing agent to be provided to the supply roller, the developing agent in the storing means being provided upstream of the supplying portion with respect to a rotating direction of the supply roller; and a disordering member, mounted downstream of the supply portion for disordering the developing agent on the surface of the supply roller, the disordering member having a contacting portion which is arranged in contact with the surface of the supply roller at a contact depth of from 0.1 mm to 2.0 mm, the contacting portion triboelectrically charging the developing agent on the supply roller, the contacting portion including a base member and a plurality of fibers implanted in the base member, the fibers contacting the supply roller.

18. The image forming apparatus according to claim 17, wherein the fibers have 1 to 10 denier thickness, 0.2 mm to 5.0 mm length and 10,000/cm$^2$ to 50,000/cm$^2$ density.

19. The image forming apparatus according to claim 18, wherein the fibers include at least one of nylon fibers, rayon fibers, acrylic fibers, polyester fibers, carbon-dispersed nylon fibers, carbon-dispersed rayon fibers, carbon-dispersed acrylic fibers and carbon-dispersed polyester fibers.

20. The image forming apparatus according to claim 17, wherein substantially all of the fibers are implanted in the base member at a predetermined non perpendicular angle.

21. The image forming apparatus according to claim 20, wherein the fibers are inclined with the rotational direction of the supply roller.

22. An image-developing method for developing a latent image on an image bearing member, comprising the steps of:

supplying a developing agent to a supply roller rotatably mounted, the supplying roller having a resilient foam polymer surface layer;

supplying the developing agent from the resilient foam polymer surface layer to a developing roller rotatably mounted adjacent to the supply roller, supplying the developing agent from the developing roller to the image bearing member rotatably mounted adjacent to the developing roller to develop the latent image; and disordering the developing agent on the surface of the supply roller to an extent sufficient to prevent the developing agent from causing hardening of the resilient foam polymer surface layer.

* * * * *